US005207347A

United States Patent [19]

Wilkey

[11] Patent Number: 5,207,347

[45] Date of Patent: May 4, 1993

[54] POSTAL TRAY ADJUSTABLE ORGANIZER

[76] Inventor: James R. Wilkey, 6328 Farris Dr., Lakeland, Fla. 33811

[21] Appl. No.: 864,033

[22] Filed: Apr. 6, 1992

[51] Int. Cl.[5] ..... B65D 1/24

[52] U.S. Cl. ..... 220/541; 220/534; 220/543; 220/559; 206/425; 206/556; 206/561

[58] Field of Search ..... 206/425, 556, 560, 561; 220/529, 531, 534, 541, 543, 559

[56] References Cited

U.S. PATENT DOCUMENTS

| | | | |
|---|---|---|---|
| 875,933 | 1/1908 | Kimes | 220/541 |
| 1,016,890 | 2/1912 | Meleney | 220/541 |
| 1,050,166 | 1/1913 | Peterson | 220/534 |
| 1,231,154 | 6/1917 | Hatfield | 220/541 |
| 1,279,621 | 9/1918 | Webber | 220/541 |
| 2,746,457 | 5/1956 | Musacchia | 220/543 |
| 3,269,392 | 8/1966 | McLain | 220/529 |
| 3,279,642 | 10/1966 | Kafferlin | 220/543 |
| 3,291,134 | 12/1966 | Novales | 220/559 |
| 3,491,909 | 1/1970 | Ikelheimer | 220/529 |
| 3,558,025 | 1/1971 | Blake | 206/425 |
| 3,746,181 | 7/1973 | Benoit | 220/529 |
| 4,643,306 | 2/1987 | Ryan | 206/425 |

FOREIGN PATENT DOCUMENTS

| | | | |
|---|---|---|---|
| 1964321 | 1/1971 | Fed. Rep. of Germany | 220/531 |
| 718862 | 11/1954 | United Kingdom | 220/529 |

*Primary Examiner*—David T. Fidei

[57] ABSTRACT

A Postal Tray Adjustable Organizer, comprising a translucent framework comprising an upright portion, and a flat bottom portion, slideably affixed into the inner cavity of a Postal Tray, the Postal Tray being either of the flexible, or of the solid side structure, the translucent framework having a spring loaded, sidewardly extending shaft, affixed onto the bottommost peripheral of the upright portion of the translucent framework. For use in a Postal Tray fabricated of a flexible, less costly design, the translucent framework having a flat metal strip affixed along the uppermost peripheral of the upright portion, the metal strip being bent downwardly along the outside side of the flexible Postal Tray, thereby trapping the side material of the flexible Postal Tray between the flat metal strip, and the spring loaded shaft ends. In this manner, the remaining mail in the Postal Tray is secured in the upright position, as the mail is delivered.

5 Claims, 1 Drawing Sheet

POSTAL TRAY ADJUSTABLE ORGANIZER

BACKGROUND OF INVENTION

This invention relates to an apparatus and method of providing means for securing mail, or other items, in an organized, and easily identifiable order, in a Postal Tray, or other means, when the Postal Tray is not full, or, after some portion of the mail has been removed from the Postal Tray.

It has been customary for Postal Delivery personnel to organize the mail for their route, place it in a furnished Postal tray, and place the tray in the Postal delivery vehicle, within easy reach, and identification, and step by step, packet by packet, remove the mail in an organized manner, and deliver the mail for their route.

A problem soon develops in the Postal tray. As the mail is removed, and delivered from the front of the Postal tray, and during driving the Postal Vehicle, the mail slips from its intended position, lays flat on the bottom of the Postal tray, sometimes being mixed into an unorganized sequence, thereby causing the Postal Delivery person to spend several minutes reorganizing the mail each time a delivery to the next customer on the route is required.

Several approaches to solving this problem have been provided. Usually, each Postal delivery person uses some type of personal separator, carried in their individual Postal Delivery Vehicle, for their own use. These individual separators can be lost, left at home, or suffer some other mishap. Also, a new type of Postal Tray is being procured for these purposes, and, the new type is of a lighter weight, flexible side design, which does not conform to a typical separator. The older Postal Trays are still in use today, presenting a dual problem for the separation, and secure holding of the mail in these Postal Trays.

Several approaches to solving the problem of securing the mail in the Postal Trays have been provided. Reseda, in U.S. Pat. No. 4,643,306 teaches a completely new Postal Tray, equipped with individual tray dividers. The problem with this apparatus is that the mail is of many sizes, and types, and placing an opaque separator in a slot in the Postal Tray presented by Reseda, would be cumbersome at best, and restrict the visual identification of the mail by the Postal Delivery person.

Ikelheimer, in U.S. Pat. No. 3,491,909 teaches a method and apparatus of separating a tray, or, enclosure into individual compartments. Here again, the daily mail to be delivered does not conform to pre-measured quantities, and the type of separation provided by Ikelheimer would be very cumbersome, and time consuming.

Benoit, in U.S. Pat. No. 3,746,181 teaches a series of individual separators, each separator having a base portion, and the base portion of the separator being loaded with articles to keep it in place. This type of separator is designed for a static storage of articles, and is not designed for a constant changing of articles in the tray, as is present in the mail delivery system.

SUMMARY OF THE INVENTION

Accordingly, it is an object of this invention to provide a new and improved method and apparatus for the continual securing of the mail in a Postal Tray during delivery, or otherwise, providing means for securing the individual articles of mail in an upright position, providing means for easy identification of each piece of mail, and, preventing the slippage and inter-mixing of the remaining pieces of mail in the Postal Tray, after a quantity of mail has been removed from the Postal Tray.

It is another object of this invention to provide means for securing the mail in a Postal Tray, when the Postal Tray being used is of a solid side design.

It is another object of this invention to provide means for securing the mail in the Postal Tray, when the Postal Tray is of a flexible side design.

It is another object of this invention to provide the securing means of a translucent material, thereby providing means for easy identification of trapped mail in the tray.

It is still another object of this invention to provide this securing means whereby said securing means can be slid from the rear of the Postal Tray, to the front of the Postal Tray, thereby providing means for securing the remaining mail in the Postal Tray from the first mail delivery to the last mail delivery, thusly eliminating this distraction from the driving of the Delivery Vehicle.

In carrying out this invention in the illustrative embodiment thereof, a Postal Tray Adjustable Organizer, comprising an upright portion, and a bottom portion, is inserted into a flexible side Postal Tray, said Postal Tray Adjustable Organizer having two vertical side pieces, said side pieces being permanently affixed along the uppermost portion of said Postal Tray Adjustable Organizer, and said side pieces being bent 90 degrees downward, at the outward most extension, and then being fitted downward, along the outside of the Postal Tray.

Now, a lengthwise, finger operated, spring loaded shaft having been affixed along the bottommost portion of the upright portion of the Postal Tray Adjustable Organizer, and having means to extend outwardly against the sides of the flexible side Postal Tray, and the spring loaded shaft providing means for providing a holding tension between the two ends of the spring loaded shaft, and the two side pieces of the Postal Tray Adjustable Organizer, thereby trapping the sides of the flexible Postal Tray, and causing the Postal Tray Adjustable Organizer to be held in the desired location inside the flexible Postal Tray, also securing the mail in the flexible Postal Tray in a desired, upright, easily identifiable position. Also, as the Postal Tray Adjustable Organizer is made of a translucent material, the Postal Delivery person can easily detect any entrapped mail in the Postal Tray.

Conveniently, the user may grasp the two spring release handles of the spring loaded shaft, thereby releasing the spring tension against the two side pieces of the Postal Tray Adjustable Organizer, and providing means for the two side pieces to be affixed downwardly, along the outside of the flexible Postal Tray, while at the same time inserting framework of the Postal Tray Adjustable Organizer inside the flexible Postal Tray. The Postal Tray Adjustable Organizer is then slid forward in the flexible Postal tray, thereby securing all of the mail in an upright, edgewise position, against the front of the flexible Postal Tray.

When the Postal Tray Adjustable Organizer is in the desired location, securing all of the mail in the flexible Postal Tray, the two hand control pieces are released, thereby causing the spring loaded shaft to hold the Postal Tray Adjustable Organizer in the desired position until moved again. As the mail is delivered, the Postal Delivery person continually moves the Postal Tray Adjustable Organizer forward in the flexible Postal Tray, thereby continually securing all of the remaining mail in the Postal Tray, in an easily identifiable position, and allowing the driver to drive more safely, not having to pay attention to the remaining mail sliding and mixing in the Postal Tray.

BRIEF DESCRIPTION OF THE DRAWINGS One sheet of drawings is furnished.

DESCRIPTION OF THE PREFERRED EMBODIMENTS

Figure 1:
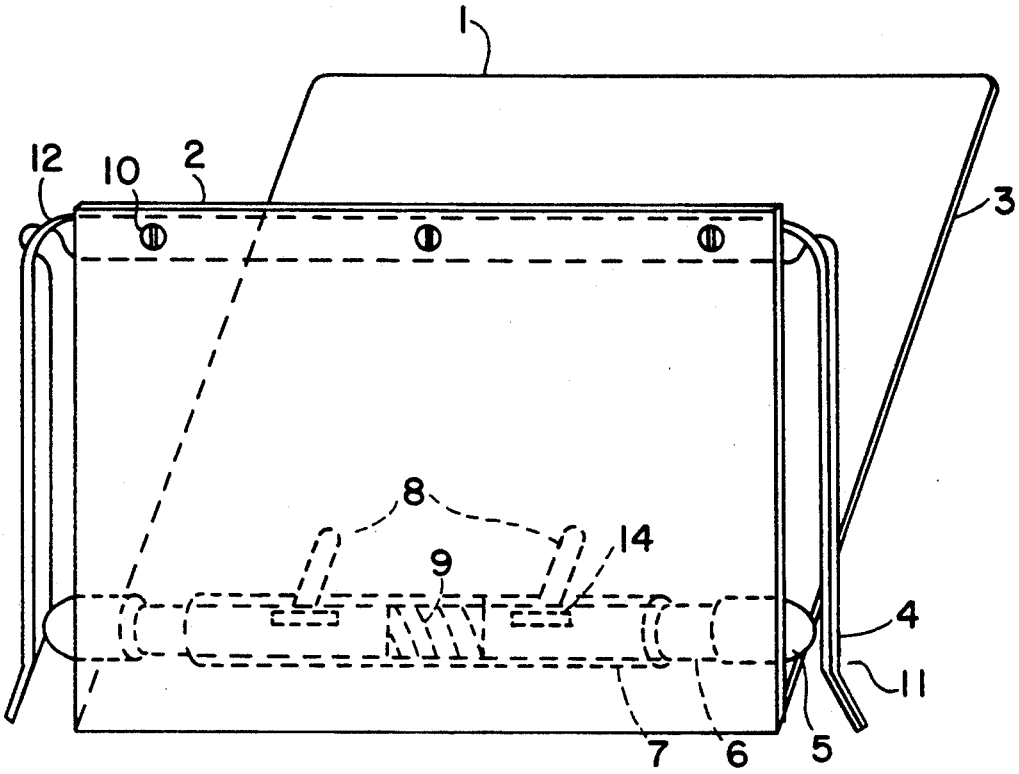
FIG. 1 is a perspective view of the invention, showing the securing means in dashed lines.

Referring now to FIG. 1, a Postal Tray Adjustable Organizer, referred to generally by the reference numeral 1 is made of an L shaped translucent material, comprising a flat upright portion 2, and a flat bottom portion 3 of a size to fit into the inside of a Postal Tray 13. The flat bottom portion 3 laying along the bottom of the Postal Tray 13 and the flat upright portion 2 extending upwardly inside Postal Tray 13 provides a means for holding the mail upright in Postal Tray 13, and in a secured position, providing means for easily identifying the next piece of mail to be delivered.

Now, and still referring to FIG. 1, a strip of material 4 is affixed along the topmost portion of the upright portion 2, by a plurality of screws 10, and the strip of material 4 having a 90 degree bend 12 at each end of upright 2, and then being extended downwardly along the sides of upright 2. Each end of strip material 4 has a relief 11 bent into each end thereby providing for easy insertion of the Postal Tray Adjustable Organizer 1 into the Postal Tray 13.

Figure 2:
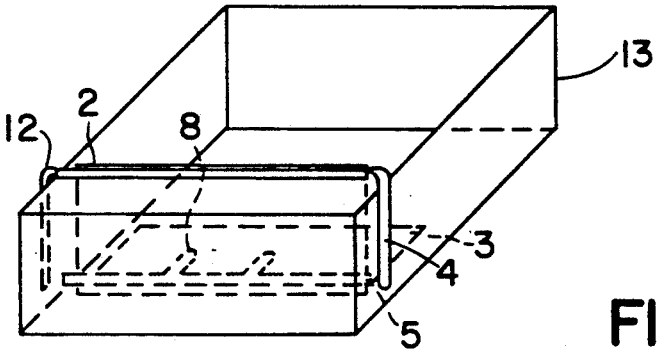
FIG. 2 is a perspective view of a typical Postal Tray with the invention secured along the sides of the Postal Tray.

At the bottommost portion of the upright 2 two spring loaded shafts 6 are enclosed inside a retaining sleeve 7 affixed to flat up right 2. The two spring loaded shafts 6 each have a hand operated release handle 8 projecting outwardly therefrom and held in their extended position against angled end piece 4 by the tension of spring 9. Each release handle 8 permits inward sliding of shafts 6 against a compression spring 9. The handles 8 protrude outward from shafts 6 through two retaining slots 14 in sleeve portion 7, thereby providing means for releasing two friction end pieces 5 from contact with the two ends of the strip of material 4. The friction end pieces 5 are attached to the outer ends of the two slidable shafts 6 with the two slidable shafts 6 being located within the sleeve portion 7 and abutted against spring 9. The Postal tray adjustable Organizer 1 is inserted into the Postal tray 13, as seen in FIG. 2, and the two end pieces 11 of the strip of material 4 are extended outward and downward along the outside of the Postal Tray 13. At this point, the user squeezes the two handles 8 inward, thereby releasing end pieces 5 from the sides of the Postal Tray and the Postal Tray Adjustable Organizer 1 is slid forward, and against the rear of the last piece of mail in the Postal Tray 13. The hand operated spring release handles 8 then being released, allow the spring 9 to apply a friction locking pressure to friction end pieces 5 against two strips of material 4, thus trapping the Postal Tray Adjustable Organizer 1 against the sides of the flexible Postal Tray 13 and providing means for friction locking the Postal Tray Adjustable Organizer 1 in place. Thereby securing all of the remaining mail in the flexible Postal Tray 13 in an upright, easily read position.

Accordingly, a very unique, attractive, convenient method and apparatus are provided for securing the remaining mail in a Postal Tray, and easily identifying the next addressee to be delivered, and all the while not distracting from the driving of the Delivery Vehicle.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. An adjustable organizer for insertion into a postal tray comprising;

a L-shaped member defined by an upright portion having a top, opposed sides and a projecting flat bottom portion, a strip of material extending across the top and outwardly of the sides of said upright portion, said strip having a downwardly extending portion wherein said downwardly extending portion is spaced from an upright portion side to form an opening for straddling the side of a postal tray, a retaining sleeve, affixed to said L-shaped member, having an open end an at least one slot formed in said sleeve, an elongated shaft having a handle projecting outwardly from said shaft, a spring encapsulated by said sleeve and having said shaft engaging an end of said spring with said handle projecting within said sleeve and permit said shaft to project beyond the open end of said sleeve to thereby clamp the side of a postal tray between said shaft and said downwardly extending portion.

2. An adjustable organizer as set forth in claim 1 wherein said sleeve includes a second open end and a second elongated shaft extending beyond said second end, said second elongated shaft engaging said spring such that a handle formed on said second elongated shaft projects outwardly through said second slot, wherein longitudinal movement of the handles relative to said sleeve causes axial movement of the shafts within the sleeve to thereby clamp said L-shaped member between opposite sides of a postal tray.

3. An adjustable organizer as set forth in claim 1 or 2 wherein said downwardly extending portion terminates in an outwardly bent free end that provides a relief for easy insertion of the adjustable organizer onto a postal tray.

4. An adjustable organizer for insertion into a tray comprising;

a divider member of a size for sliding movement within a tray, a retaining sleeve, affixed to said divider member, having an open end and a slot formed on said sleeve, an elongated shaft having a projection extending outward from said shaft, compression means for applying a force, said compression means encapsulated by said sleeve and in engagement with an end of said shaft such that said shaft is received within said sleeve and said projection extends through said slot, wherein said projection controls axial sliding movement of said shaft within said sleeve and said compression means urges said shaft beyond the open end of said sleeve to thereby fasten said divider member to a tray.

5. An adjustable organizer as set forth in claim 4 wherein said sleeve includes a pair of slots, two open ends and a pair of elongate shafts received within said sleeve, each shaft having an outward projection extending through a slot on said sleeve for controlling axial movement of the shafts within said sleeve, said compression means engaging an end of each shaft thereby urging each said shaft beyond a respective open end of said sleeve to fasten said divider member between opposite sides of a tray.

* * * * *